US006502717B1

(12) United States Patent
Wolfe

(10) Patent No.: US 6,502,717 B1
(45) Date of Patent: Jan. 7, 2003

(54) CHILD RESISTANT PILL DISPENSING PACKAGE

(75) Inventor: Steven R. Wolfe, Maumee, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 10/040,234

(22) Filed: Oct. 24, 2001

Related U.S. Application Data

(62) Division of application No. 09/545,846, filed on Apr. 7, 2000, now Pat. No. 6,364,155.

(51) Int. Cl.[7] ..... G07F 11/66
(52) U.S. Cl. ..... 221/25; 221/86
(58) Field of Search ..... 221/2, 7, 13, 25, 221/26, 86, 88, 76, 82; 206/531, 534, 539

(56) References Cited

U.S. PATENT DOCUMENTS

| | | | | |
|---|---|---|---|---|
| 3,651,984 | A | | 3/1972 | Redenback |
| 4,015,717 | A | | 4/1977 | Richardson et al. |
| 4,124,143 | A | | 11/1978 | Thomas |
| 4,164,301 | A | | 8/1979 | Thayer |
| 4,165,709 | A | | 8/1979 | Studer |
| 4,572,376 | A | | 2/1986 | Wrennall |
| 4,646,936 | A | | 3/1987 | Frazier et al. |
| 4,667,845 | A | | 5/1987 | Frazier et al. |
| 4,706,815 | A | | 11/1987 | Curtis et al. |
| 4,756,423 | A | | 7/1988 | Holtsch |
| 4,838,453 | A | | 6/1989 | Luckstead |
| 4,905,866 | A | | 3/1990 | Bartell et al. |
| 4,915,256 | A | * | 4/1990 | Tump ..... 221/5 |
| 4,971,221 | A | | 11/1990 | Urquhart et al. |
| 5,154,296 | A | | 10/1992 | Cutler |
| 5,265,728 | A | * | 11/1993 | Allendorf et al. ..... 206/534 |
| 5,322,166 | A | | 6/1994 | Crowther |
| 5,352,465 | A | | 10/1994 | Gondek et al. |
| 5,392,952 | A | | 2/1995 | Bowden |
| 5,562,231 | A | | 10/1996 | Lambelet, Jr. et al. |
| 5,570,810 | A | | 11/1996 | Lambelet, Jr. et al. |
| 5,575,392 | A | | 11/1996 | Cutler |
| 5,775,536 | A | | 7/1998 | Lambelet, Jr. et al. |
| 5,799,821 | A | | 9/1998 | Lambelet, Jr. et al. |
| 5,975,347 | A | | 11/1999 | Lambelet, Jr. et al. |
| 6,037,208 | A | * | 3/2000 | Lambelet, Jr. ..... 231/75 |
| 6,098,835 | A | | 8/2000 | DeJonge |
| 6,138,866 | A | | 10/2000 | Lambelet, Jr. et al. |
| 6,145,697 | A | | 11/2000 | Gudish |
| 6,193,103 | B1 | | 2/2001 | Clarijs |
| 6,206,233 | B1 | | 3/2001 | Schulze |
| 6,234,343 | B1 | | 5/2001 | Papp |

* cited by examiner

*Primary Examiner*—Kenneth W. Noland

(57) ABSTRACT

A pill dispensing package that includes a circular base having a pill dispensing opening adjacent to its periphery. A circular package disk has a peripheral array of frangible elements containing pills to be dispensed disposed for selective alignment with the base dispensing opening, and indicia for indicating dosage periodicity. A circular cover overlies the package disk, and is moveably secured to the base. The cover has a window for observing the periodicity indicia on the package disk, and a button for manual urging against the package disk to dispense a pill through the base opening from the frangible element aligned with the opening. The cover is resiliently urged axially away from the base and circumferentially with respect to the base, and is constructed to permit limited axial and circumferential movement with respect to the base. When the cover is moved toward the base, the cover engages the package disk for rotating the disk with respect to the base and thereby advance the package disk for the next pill dispensement. Pill dispensement requires both axial and circumferential motion of the cover with respect to the base, as well as depression of the button on the cover, a series of movements that resists use by a child.

8 Claims, 5 Drawing Sheets

CHILD RESISTANT PILL DISPENSING PACKAGE

This application is a division of application Ser. No. 09/545,846 filed Apr. 7, 2000 now U.S. Pat. No 6,364,155.

The present invention is directed to packages for dispensing pills in periodic dosages, such as daily dosages.

BACKGROUND AND SUMMARY OF THE INVENTION

It is an object of the present invention to provide a pill dispensing package that is child resistant in the sense of resisting dispensing of pills by a child, that is day compliant in the sense of providing facility for observing each day of dispensation, and/or that is compact and may be readily carried in a pocket or purse. Another object of the present invention is to provide a child resistant pill dispensing package that employs preassembled blister packs of pills to be dispensed, and in which the package may be readily disassembled by a pharmacist or user to replace the blister pack when empty. Yet another object of the present invention is to provide a blister pack configured for use in such a pill dispensing package. A further object of the invention is to provide a pill dispensing package that achieves one or more of the foregoing objectives, that is economical to manufacture, and that has an extended operating lifetime under conditions of normal use.

A pill dispensing package in accordance with a presently preferred embodiment of the invention includes a circular base having a pill dispensing opening adjacent to its periphery. A circular package disk has a peripheral array of frangible elements containing pills to be dispensed disposed for selective alignment with the base dispensing opening, and indicia for indicating dosage periodicity. A circular cover overlies the package disk and is moveably secured to the base. The cover has a window for observing the periodicity indicia on the package disk, and a button for manual urging against the package disk to dispense a pill through the base opening from the frangible element aligned with the opening. The cover is resiliently urged axially away from the base and circumferentially with respect to the base, and is constructed to permit limited axial movement and limited circumferential movement with respect to the base. When the cover is moved toward the base, the cover engages the package disk for rotating the disk with respect to the base and thereby advance the package disk for the next pill dispensement. Pill dispensement requires both axial and circumferential motion of the cover with respect to the base, as well as depression of the button on the cover, a series of movements that resists use by a child.

In the preferred embodiment of the invention, the circular package disk comprises a disk element having a peripheral array of openings for selective alignment with the dispensing opening in the base, and a replaceable blister pack having pill-containing frangible elements disposed in alignment with the openings in the disk element. The base, disk element and cover are of molded plastic construction. A first circumferential array of spring elements is molded integrally with the cover for engaging the base through a central opening in the disk element resiliently to urge the cover axially away from the base. The cover has integral arcuate legs that extend through arcuate openings in the base for securing the cover to the base. The base has arcuate spring elements integrally molded adjacent to arcuate ends of the openings for engaging the legs on the cover and thereby urging the cover circumferentially with respect to the base.

Teeth are integrally molded on the cover and around the central opening in the disk element for engagement between the cover and the disk element when the cover is moved axially toward the base. Thus, to dispense a pill from the blister pack, the cover is moved axially toward the base to bring the teeth on the cover and disk element into engagement, and then moved circumferentially with respect to the base. The amount of circumferential movement, determined by the size of the arcuate openings in the base relative to the size of the arcuate legs on the cover, corresponds to the angular separation between blister elements in the blister pack. When the cover and blister pack have been moved one angular increment, the cover is released and returned by the circumferential spring elements to its initial position. The corresponding dosage indicia may be observed through the window opening in the cover, and the button integrally molded on the cover may be depressed to dispense the corresponding pill from the blister pack through aligned openings in the disk element and the base.

In accordance with another aspect of the present invention, there is provided a blister pack of pills that includes a flat circular base having a plurality of frangible elements containing pills to be dispensed around the periphery of the base, and indicia for indicating dose periodicity on the flat circular base radially aligned with each associated frangible element. There is at least one gap equal to two such angular increments between elements in the array, so that a package including the blister pack may be initially provided by a pharmacist to a user without a pill-containing element in registry with the dispensing button and the dispensing openings in the package. First use by the user will thus require axial and circumferential motion of the cover with respect to the base to advance the blister pack to the first dispensing position, at which the pill may then be immediately dispensed. In this way, there will not be a pill-containing element in registry with the dispensing button and the dispensing opening except immediately prior to each dispensation.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 11:
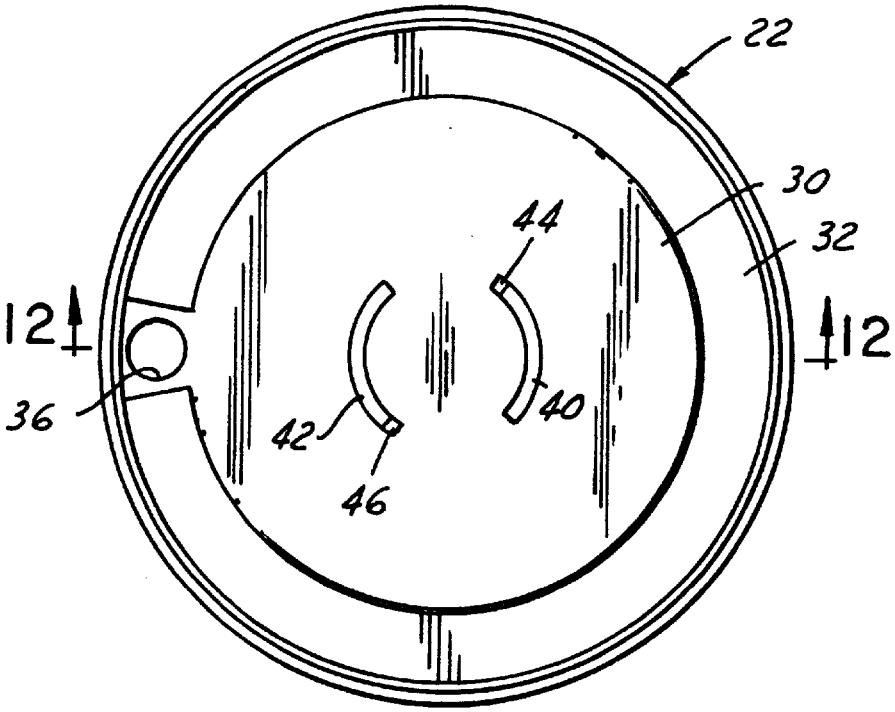
FIG. 11 is a top plan view of the package base.

The drawings illustrate a package 20 in accordance with a presently preferred embodiment of the invention as a sandwiched assembly that includes a base 22, a cover 24, an indexing disk 26 and a blister pack 28. Base 22 (FIGS. 2–6 and 11–12) comprises a flat circular base wall 30 having an annular depression or channel 32 part way around its peripheral edge, and an annular flange 34 that extends axially from the outer periphery of channel 32. A circular dispensing opening 36 is positioned adjacent to flange 34 in a gap formed in channel 32. Flange 34 has an axially facing radially outwardly extending shoulder 38. A pair of arcuate openings 40, 42 are disposed in base wall 30 at constant radius from the central axis of base 22. Base 22 is of molded plastic construction, and a pair of spring elements 44, 46 integrally extend axially and circumferentially from base wall 30 at the counter-clockwise edges of associated arcuate openings 40, 42 (as viewed in FIG. 11). Each spring element 44, 46 is essentially flat and rectangular, extending at an angle to the plane of base wall 30 underlying openings 40, 42.

Figure 8:
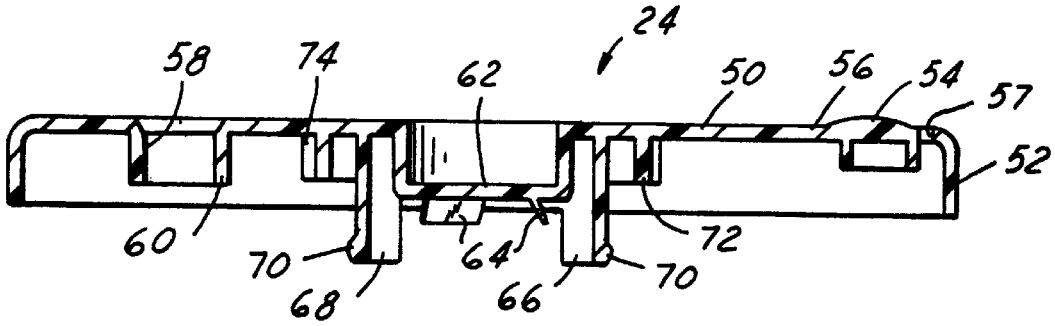
FIG. 8 is a sectional view of the package cover, being taken substantially along the line 8—8 in FIG. 9.
Figure 9:
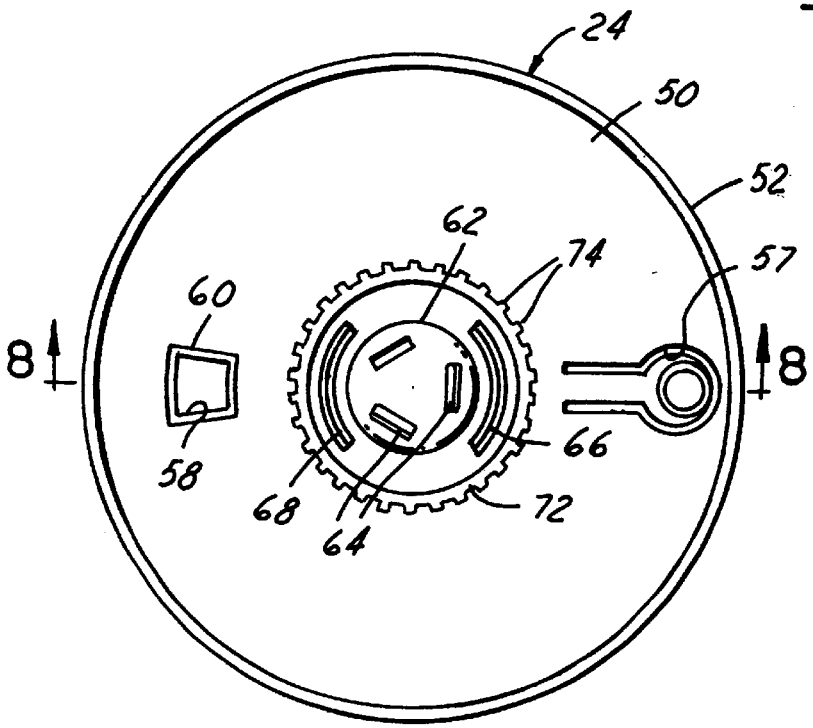
FIG. 9 is a bottom plan view of the package cover.

Cover 24 (FIGS. 1 and 3–9) is of one-piece molded plastic construction, and includes a flat base wall 50 and a depending peripheral skirt 52. A button 54 is cantilevered from base wall 50 by an integrally molded spring arm 56, with button 54 and spring arm 56 lying in a keyhole-shaped opening 57 in base wall 50. Spring arm 56 and button 54 are normally disposed in the plane of base wall 50. A window 58 is disposed in base wall 50 diametrically opposite button 54, and is defined by a flange 60 (FIGS. 4 and 8) that depends from the base wall—i.e., extends downwardly from the base wall as viewed in FIG. 8. There is a circular depression 62 at the center of base wall 50, and three circumferentially spaced spring fingers 64 integrally depend from depression 62. Spring fingers 64 are essentially rectangular, and extend tangentially of the central axis of cover 24, and axially downwardly and radially outwardly from the flat wall of depression 62. Radially outwardly of depression 62 and spring fingers 64, a pair of arcuate radially resilient legs 66, 68 depend from base wall 50 of cover 64. Each leg 66, 68 has a radially outwardly extending round foot 70 at the free end thereof. Legs 66, 68 extend at constant radius with respect to the axis of cover 24. Radially outwardly of legs 66, 68, there is an annular wall 72 that depends from cover base wall 50. A circumferentially continuous series of axially extending radially outwardly facing teeth 74 extend entirely around wall 72.

Figure 3:
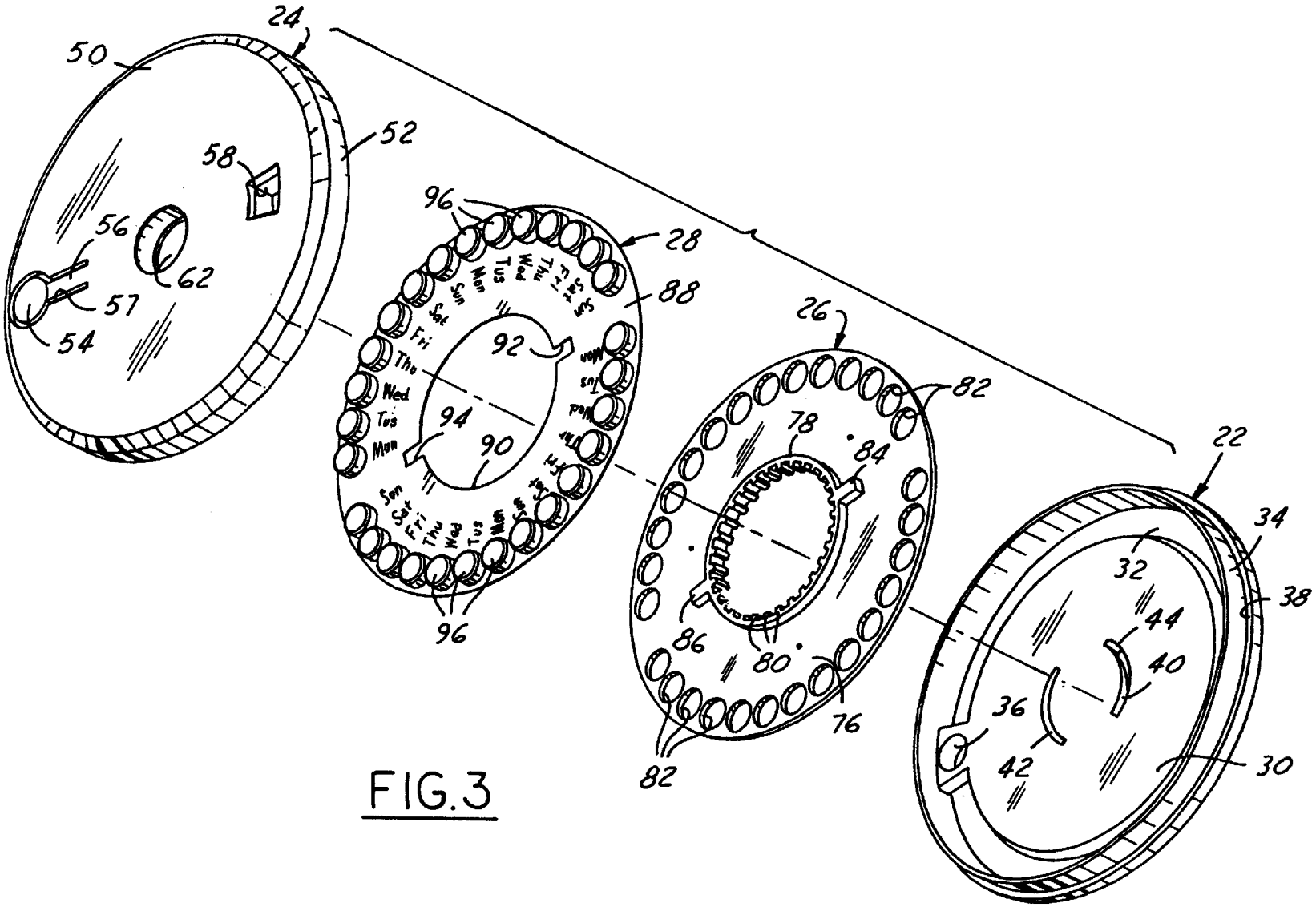
FIG. 3 is an exploded perspective view of the package illustrated in FIGS. 1 and 2.
Figure 4:
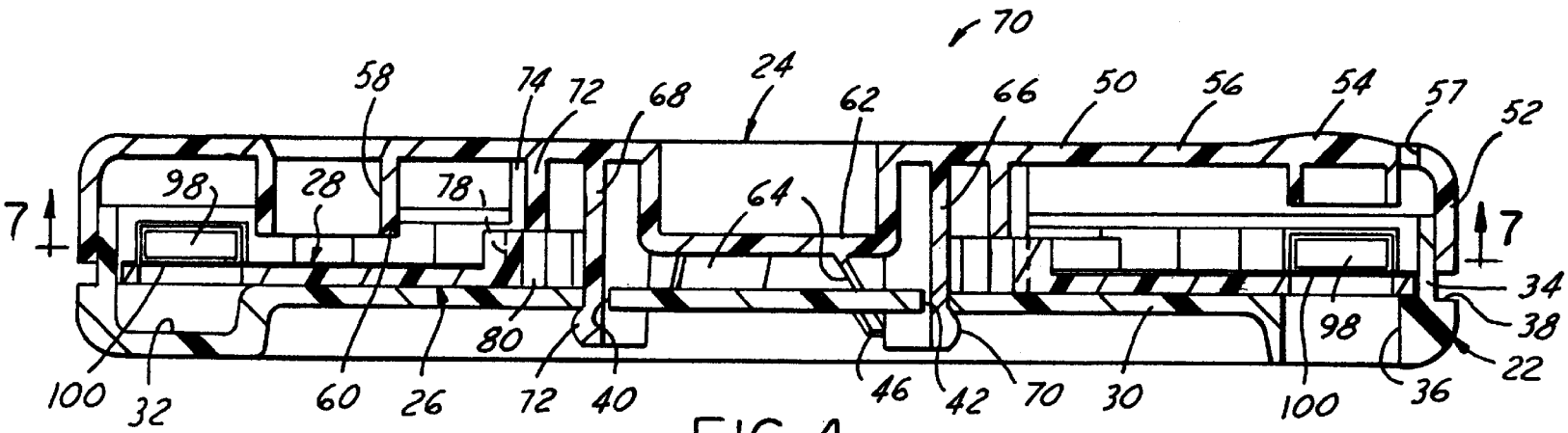
FIG. 4 is a sectional view taken substantially along the line 4—4 in FIG. 1.
Figure 6:
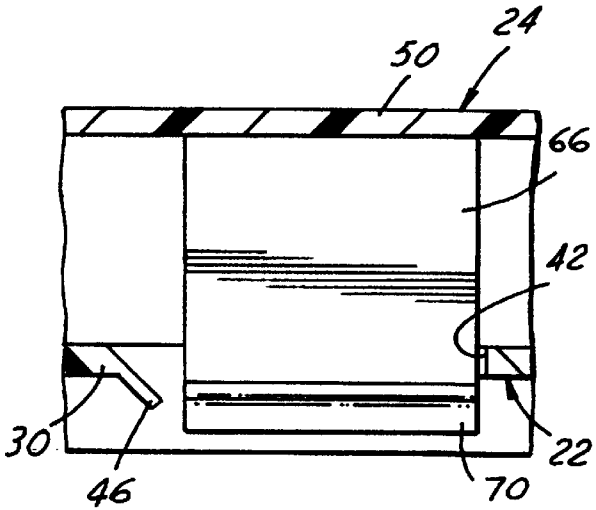
FIGS. 5 and 6 are sectional views taken substantially along the lines 5—5 and 6—6 in FIG. 2.
Figure 10:
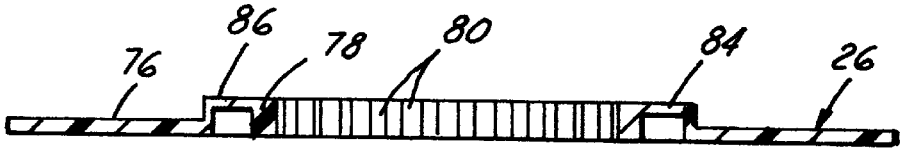
FIG. 10 is a sectional view diametrically bisecting the indexing disk of the package.
Figure 12:
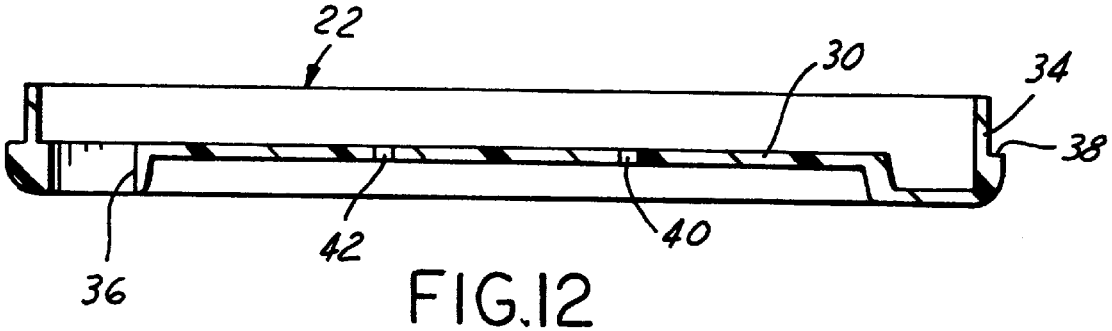
FIG. 12 is a sectional view taken substantially along the line 12—12 in FIG. 11.

Indexing disk 26 (FIGS. 3–4 and 10) is of molded plastic construction, and includes a flat annular base 76 and a raised central boss 78. A circumferential array of axially extending radially inwardly oriented teeth 80 are disposed around the inner diameter of boss 78 at a radius from the axis of disk 26 for meshing engagement with teeth 74 on wall 72 of cover 24. A circumferential array of circular openings 82 (FIG. 3) are formed in disk wall 76 around the periphery of disk 26 at a radius for selective registry between button 54 on cover 24 and dispensing opening 36 on base 22, as best seen in FIG. 4. A pair of diametrically opposed rectangular lugs 84,86 extend radially outwardly from boss 78. Openings 82 are at equal angular incremental spacing from each other, and there is a gap between openings 82 equal to two such incremental spacings in radial alignment with each lug 84, 86, as best seen in FIG. 3.

Figure 1:
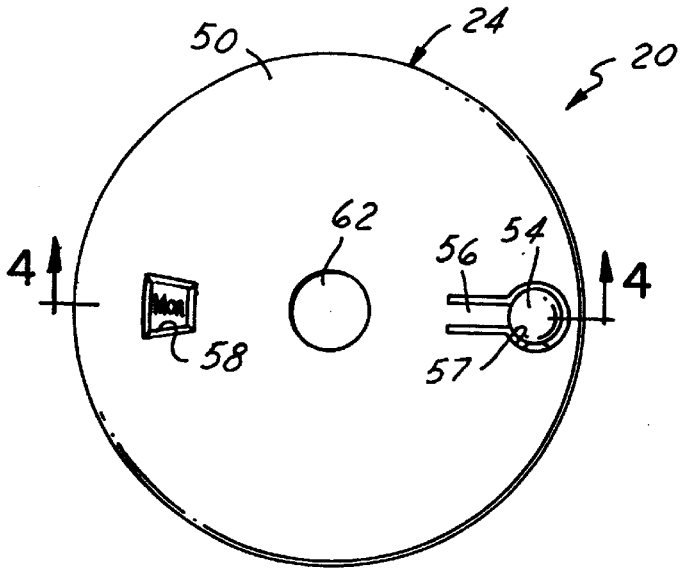
FIG. 1 is a top plan view of a pill dispensing package in accordance with a presently preferred embodiment of the invention.
Figure 2:
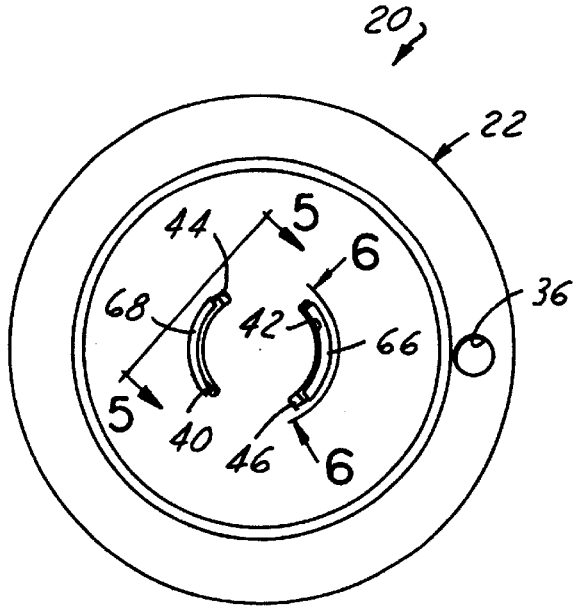
FIG. 2 is a bottom plan view of the package illustrated in FIG. 1.
Figure 7:
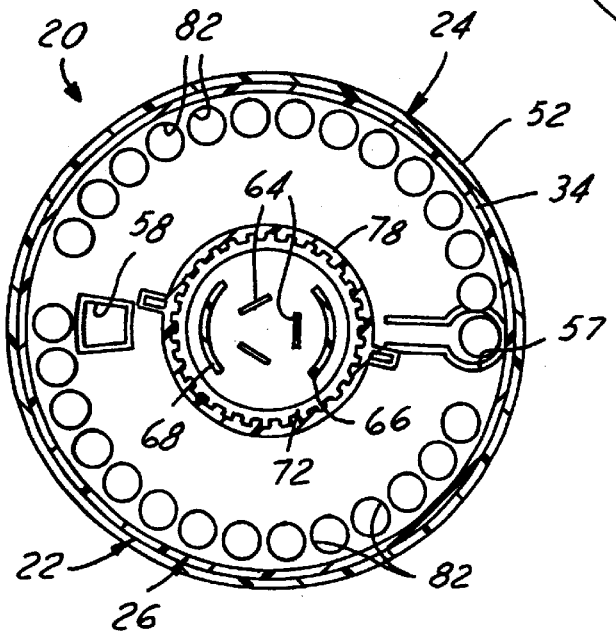
FIG. 7 is a sectional view taken substantially along the line 7—7 in FIG. 4.

Blister pack 28 comprises a flat circular base 88 having a central opening 90 of a diameter for receipt over boss 78 on disk 26, and having diametrically opposed slots 92, 94 for registry with lugs 84, 86 on disk 26 so as to maintain circumferential orientation of pack 28 with respect to disk 26. A circumferential array of angularly spaced blister pack elements 96 extend around the periphery of base 88. There is an angular gap between elements 96 in alignment with each slot 92, 94 corresponding to the gap between openings 82 in alignment with lugs 84, 86 on disk 26. Each element 96 contains a single pill 98 (FIG. 4) captured by a frangible foil or web 100. Radially inwardly of each frangible pill-containing element 96, there is a corresponding indicia for indicating dosage periodicity, such as indicia for indicating Monday through Sunday in the example of FIG. 3. These indicia are at a radius from the center of package 28 corresponding to the radius of window 58 in cover 24 so that the indicia may be observed through the window, as illustrated in FIG. 1. In the particular embodiment of the invention illustrated in FIG. 3, there are twenty-eight elements 96 with corresponding indicia designated Monday through Sunday for four weeks. Other dosage-indicating indicia can be employed, such as month dates or days and times.

Package 20 is assembled by assembling blister pack 28 onto indexing disk 26, with opening 90 over boss 78 and lugs 84, 86 in slots 92, 94. When so assembled, blister pack elements 96 automatically align with openings 82 in indexing disk 26. The subassembly of indexing disk 26 and blister pack 28 is then placed on wall 30 of base 22. The outer diameter of disk 26 and pack 28 is slightly less than the inner diameter of base peripheral wall 34, as best seen in FIG. 4, so that the base peripheral wall holds the indexing disk and blister pack subassembly in central position on the base. Cover 24 is then assembled over base 22 such that skirt 52 of cover 24 is telescopically slidably received over flange 34 on base 22, as best seen in FIG. 4. Cover legs 66, 68 are received into openings 40, 42 of base 22, with the rounded contours of feet 70 camming legs 66, 68 radially inwardly. When feet 70 clear the lower edges of openings 40, 42, legs 60, 68 return radially outwardly so as to retain cover 24 on base 22 by snap-fit. The subassembly of disk 26 and pack 28 is initially placed on base 22 with a gap between openings 82 and elements 86 in alignment with base dispensing opening 36. In this way, when cover 24 is initially positioned over base 22 so as to complete the dispensing package assembly, window 58 of cover 24 is initially aligned with a blank space in the circumferential array of indicia, and diametrically opposed button 54 is initially aligned with a blank space between blister pack elements 96, so that no pill can be dispensed at this point.

Figure 5:
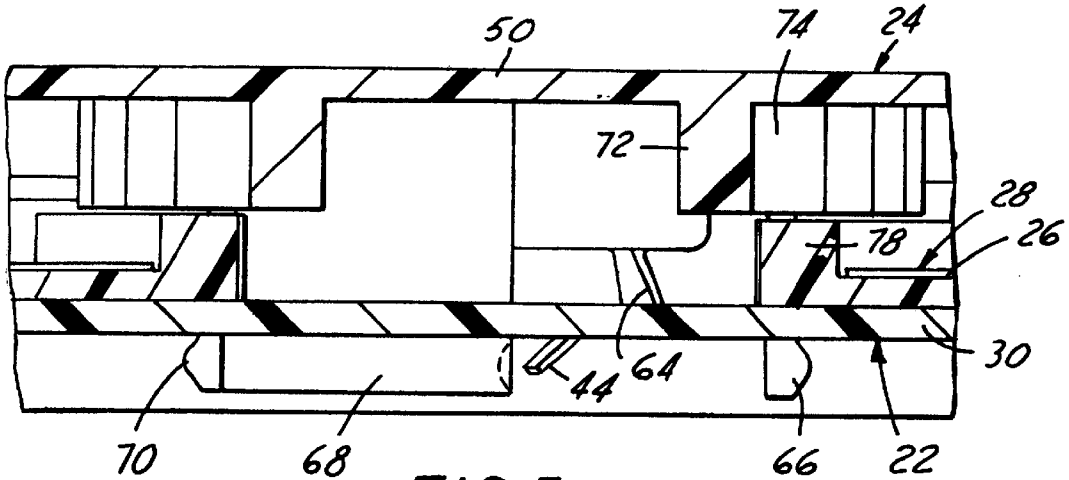

In order to dispense a pill, cover 24 is moved axially toward base 22 against the force of spring fingers 64 that are in abutting engagement with the opposing wall of base 22, as best seen in FIGS. 4 and 5. Motion of cover 24 against base 22 compresses spring elements 64 and brings teeth 74 on cover 24 into meshing engagement with teeth 80 on indexing disk 26. Downward motion of cover 24 with respect to base 22 is limited by abutment of depression 62 against cover base wall 30, and by abutment of cover skirt 52 with shoulder 38 on base 22. With teeth 74 of cover 24 meshed with teeth 80 of indexing disk 26, cover 24 is rotated counter clockwise (FIG. 1, clockwise in FIG. 2) with respect to base 22 against the forces of spring elements 46, 48 against the opposing edges of legs 66, 68. Such rotation is limited by the amount that openings 40, 42 are of greater circumferential dimension than legs 66, 68, which is preferably equal to one angular increment between openings 82 in disk 26 and blister pack elements 96 on blister pack 28. Thus, rotation of cover 24 one angular increment brings a blister pack element 96 into alignment with base dispensing opening 36. Cover 24 is then released, and rotates counter clockwise (FIG. 1) under the forces of spring elements 44, 46 against legs 66, 68, and moves axially under the forces of spring elements 64 against base wall 30. When the cover is so repositioned, cover window 58 will be in alignment with new indicia just rotated into position, and button 54 on cover 24 may be depressed so as to rupture the aligned blister pack element 96 and dispense the associated pill 98 through dispensing opening 36. Package 20 is then left in this position until the next dosage time, the next day in this particular embodiment. In the event that the user forgets whether the pill has been taken, the blister pack element may be observed through opening 36, or button 54 may be depressed, but will not dispense a new pill until the package has been indexed to the next dispensing location.

There has thus been disclosed a child-resistant pill dispensing package that fully satisfies all of the objects and aims previously set forth. The package is of light-weight molded plastic construction, and is of compact size. The package is child resistant, and is compliant with dosage periodicity. The package may be reused by removing cover 24 and replacing blister pack 28. This may be readily done by a pharmacist, for example, when filling a prescription for a new blister pack. The invention has been disclosed in conjunction with a presently preferred embodiment, and a number of modifications and variations have been described. Other modifications and variations will suggest themselves to persons of ordinary skill in the art. The invention is intended to embrace all such modifications and variations as fall within the spirit and broad scope of the appended claims.

What is claimed is:

1. A blister pack of pills comprising a flat circular base having a plurality of frangible elements containing pills to be dispensed and indicia for indicating dose periodicity on said base radially aligned with each associated frangible element, said base having a central opening with notches for interengagement with structure for rotating said pack within a dispensing package.

2. The blister pack of pills set forth in claim 1 wherein said frangible elements are provided at equal angular increments around the periphery of said base, there being at least one gap between said elements equal to two such increments.

3. The blister pack set forth in claim 1 wherein said frangible elements are disposed around an outer periphery of said base, and said indicia are disposed in radially inward alignment with said frangible elements.

4. The blister pack set forth in claim 3 wherein said indicia are radially inwardly adjacent to said frangible elements.

5. A blister pack of pills that comprises a flat circular base having a plurality of frangible elements around an outer periphery of said base and containing pills to be dispensed, and indicia for indicating dose periodicity on said base disposed radially inwardly of each frangible element for viewing through a window on a dispensing package to indicate when the pill in a frangible element should be dispensed from the package, said frangible elements being provided at equal angular increments around the periphery of said base, there being at least one gap between said elements equal to two such increments.

6. The blister pack set forth in claim 5 wherein said base has a central opening with notches for interengagement with structure for rotating said pack within a dispensing package.

7. A blister pack of pills that comprises a flat circular base having a plurality of frangible elements around an outer periphery of said base and containing pills to be dispensed, and indicia for indicating dose periodicity on said base disposed radially inwardly of each frangible element for viewing through a window on a dispensing package to indicate when the pill in a frangible element should be dispensed from the package, said base having a central opening with notches for interengagement with structure for rotating said pack within a dispensing package.

8. The blister pack set forth in claim 7 wherein said frangible elements are provided at equal angular increments around the periphery of said base, there being at least one gap between said elements equal to two such increments.

* * * * *